US007240381B1

(12) United States Patent
Hawse

(10) Patent No.: US 7,240,381 B1
(45) Date of Patent: Jul. 10, 2007

(54) COMBINATION WINDOW SEAT AND BED

(76) Inventor: Cynthia L. Hawse, 23148 Park Contessa, Calabasas, CA (US) 91302

( * ) Notice: Subject to any disclaimer, the term of this patent is extended or adjusted under 35 U.S.C. 154(b) by 0 days.

(21) Appl. No.: 11/333,902

(22) Filed: Jan. 17, 2006

Related U.S. Application Data

(60) Provisional application No. 60/644,145, filed on Jan. 14, 2005.

(51) Int. Cl.
*A47C 17/13* (2006.01)

(52) U.S. Cl. ..... 5/18.1; 5/58

(58) Field of Classification Search ..... 5/18.1, 5/17, 19, 58, 2.1
See application file for complete search history.

(56) References Cited

U.S. PATENT DOCUMENTS 1,413,595 A * 4/1922 Kreuzkamp ..... 5/18.1
2,532,355 A * 12/1950 Brown ..... 5/2.1
2,568,366 A * 9/1951 Rosen ..... 5/18.1
2,866,207 A * 12/1958 Smilow et al. ..... 5/18.1
3,385,631 A * 5/1968 Gertler ..... 297/111
3,908,210 A 9/1975 Alembik
4,166,299 A 9/1979 DuShane et al.
4,204,287 A * 5/1980 Lane et al. ..... 5/18.1
4,343,054 A 8/1982 Kane
4,481,684 A * 11/1984 Hauck ..... 5/18.1
5,101,524 A 4/1992 Brandschain
5,195,193 A 3/1993 Magistretti
6,434,766 B1 * 8/2002 Beddawi ..... 5/18.1
6,463,603 B1 * 10/2002 Camfield ..... 5/18.1
2004/0049847 A1 3/2004 Leoutsakos

* cited by examiner

*Primary Examiner*—Alexander Grosz
(74) *Attorney, Agent, or Firm*—Kenneth L Tolar

(57) ABSTRACT

A combination window seat and bed includes a front section, an intermediate section and a rear section. The front and intermediate sections can be telescopically nested beneath the rear section to form a window seat when the device is not in use. Alternatively, the front and intermediate sections can be extended from the rear section to form a king size bed. Cushion panels may be positioned on the upper surface of each of the three sections to form a padded sleeping surface. The front section includes slidable drawers for storing linens and similar accessories.

2 Claims, 3 Drawing Sheets

COMBINATION WINDOW SEAT AND BED

CROSS REFERENCE TO RELATED APPLICATIONS

This application is entitled to the benefit of provisional application No. 60/644,145 filed on Jan. 14, 2005, the specification of which is incorporated herein by reference.

BACKGROUND OF THE INVENTION

The present invention relates to a uniquely designed window seat having extendable sections allowing the window seat to be converted to a king size bed.

DESCRIPTION OF THE PRIOR ART

Dedicating a bedroom as a guest room is often undesirable in that the additional room could be more practically used as an office, a playroom or other utility type room. Accordingly, placing sofa beds and similar foldable sleeping devices within an extra room is always an option. A review of the prior art reveals a number of folding sofa beds and similar items. For example, U.S. Pat. No. 5,101,524 issued to Brandschain discloses a sofa platform bed including a stationary frame having left and right arm assemblies and a back assembly attached thereto. A pair of telescoping support members are secured to the frame member, which may be extended to buttress a collapsible mattress support platform.

U.S. Pat. No. 4,166,299 issued to DuShane et al. discloses a sofa bed including an extension that is retractably concealed within the sofa. The extension can be slid from beneath the sofa to form a bed.

U.S. published patent application 2004/0049847 on behalf of Leoutsakos discloses a bed including a mattress overlaying a foundation having drawers mounted thereon for storing personal items.

U.S. Pat. No. 3,908,210 issued to Alembik discloses a sofa having a collapsible frame assembly that may be extended to convert the sofa to a bed.

U.S. Pat. No. 5,195,193 issued to Magistretti discloses a sofa having a support frame for converting the sofa to a single bed.

U.S. Pat. No. 4,343,054 issued to Kane discloses a sofa bed combination including a sofa frame having a deployable trundle bed removably stored beneath.

As indicated above, a myriad of sofa beds and other similar collapsible bed assemblies exist in the prior art. However, each of the conventional devices includes only one or two sections thereby inhibiting their versatility. The present invention includes a three-part, telescoping frame assembly that unfurls to form a full or king sized bed while being compactly collapsible for storage, or as use as a window seat. One of the frame sections removably houses drawers for storing bedclothes and personal items.

SUMMARY OF THE INVENTION

The present invention relates to a collapsible bed. The device comprises a rear section including a planar, horizontal upper surface with a pair of opposing sidewalls and a rear wall depending therefrom. A front of the rear section is open. Slidably nested beneath the rear section is an intermediate section. The intermediate section includes a planar, horizontal upper surface with a plurality of support legs depending therefrom. The intermediate section further includes two or more tabs upwardly extending from a rear edge to prevent the intermediate section from being separated from the rear section. Slidably nested beneath the intermediate section is a front section having a planar horizontal upper surface with a plurality of support legs depending therefrom. Likewise, the front section further includes a pair of tabs upwardly extending from a rear edge that prevent the front section from being separated from the intermediate section. The front section further includes a front wall depending from its upper surface having a pair of openings positioned thereon each for slidably receiving a drawer. Varying thickness cushion panels are positioned on an upper surface of one of the sections to form a level, uniform sleeping surface when the device is expanded.

It is therefore an object of the present invention to provide a uniquely designed bed and window seat combination that allows a room to be more practically used.

It is another object of the present invention to provide a uniquely designed window seat that may be quickly and conveniently converted to a king size bed.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
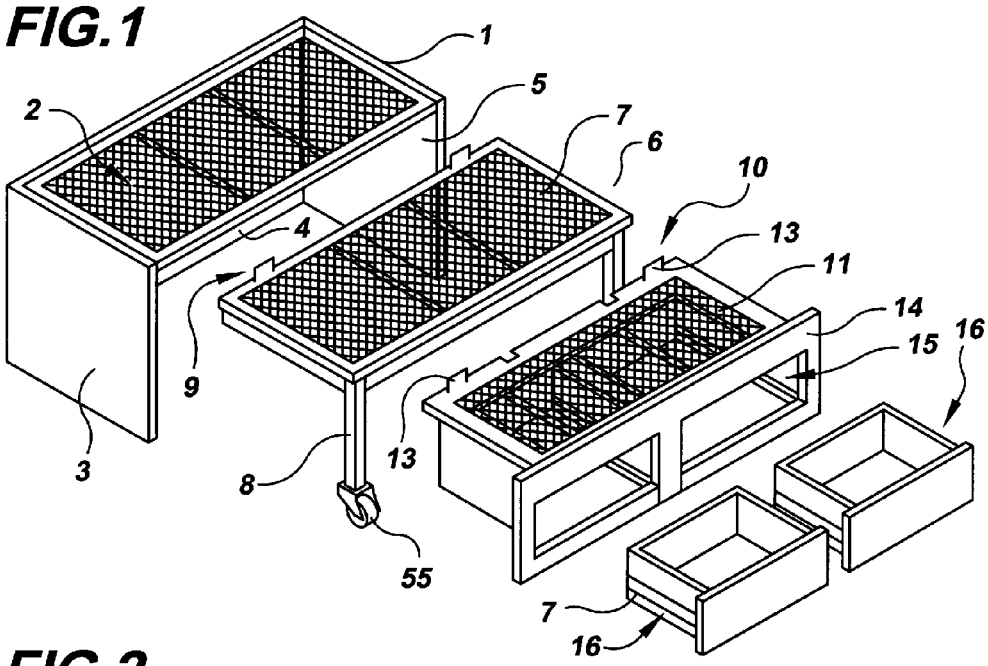
FIG. 1 is a perspective, exploded view of the device according to the present invention.
Figure 2:
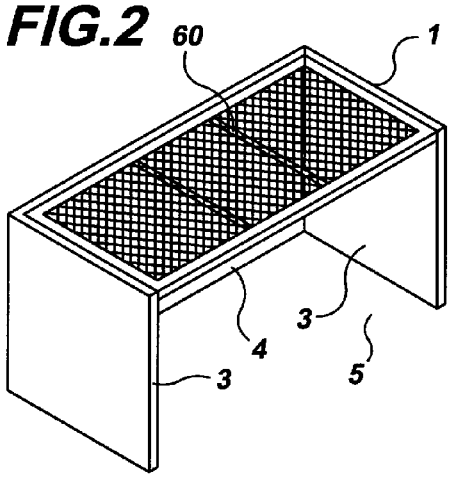
FIG. 2 is an isolated view of the rear section.
Figure 3:
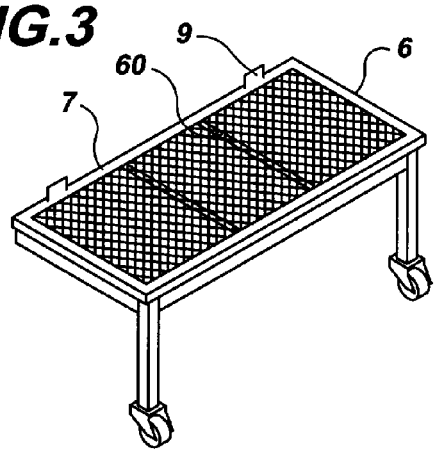
FIG. 3 is an isolated view of the intermediate section.
Figure 4:
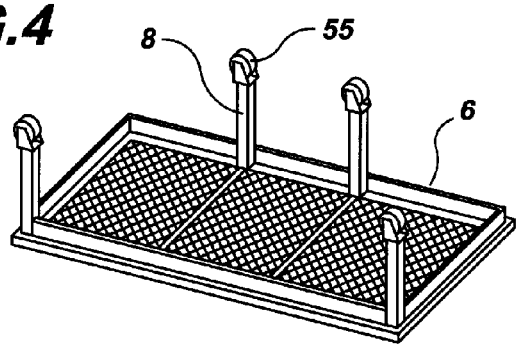
FIG. 4 is a lower view of the intermediate section.
Figure 5:
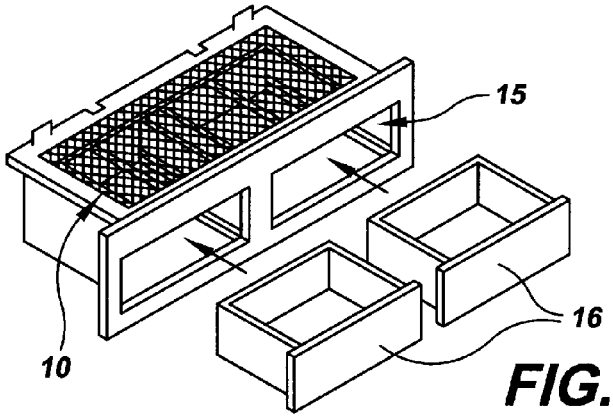
FIG. 5 is an isolated, perspective view of the front section.
Figure 6:
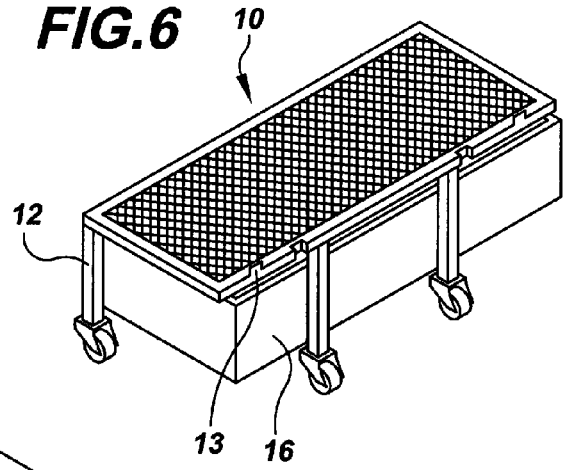
FIG. 6 is an isolated, rear view of the front section.
Figure 7:
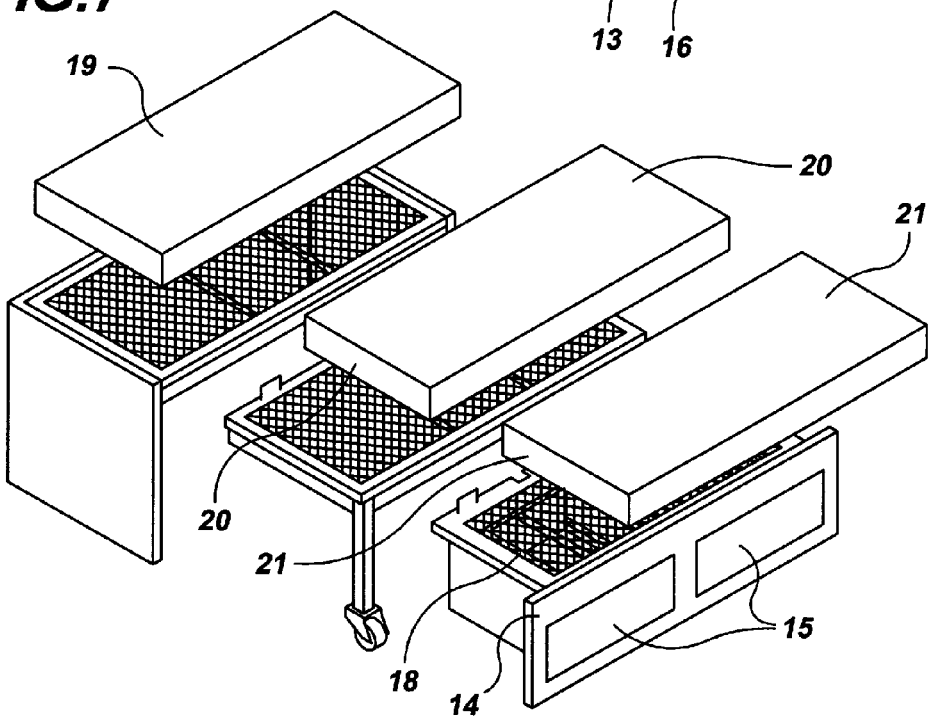
FIG. 7 depicts the device in an expanded configuration with the cushion panels offset therefrom.
Figure 8:
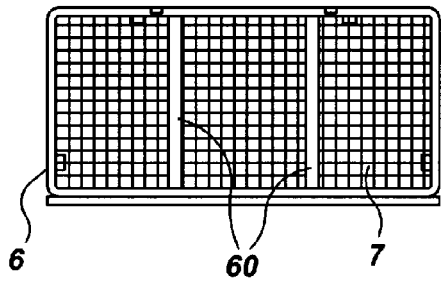
FIG. 8 is a top view of the middle section.
Figure 9:
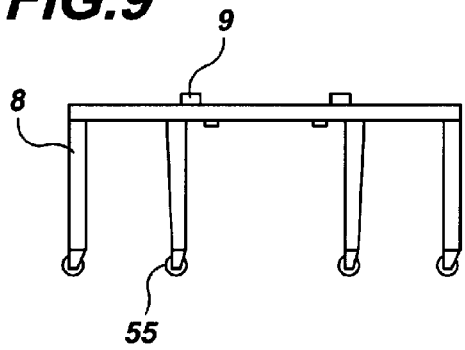
FIG. 9 is a front view of the middle section.
Figure 10:
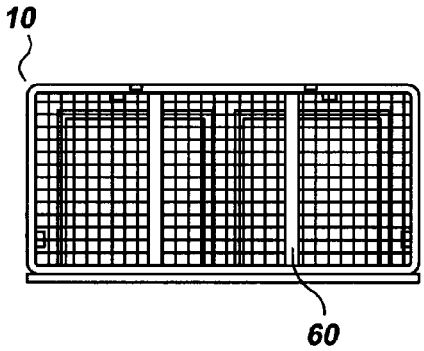
FIG. 10 is a top view of the front section.
Figure 11:
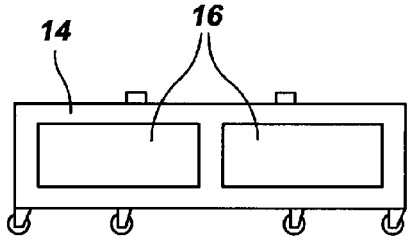
FIG. 11 is a front view of the front section.

Now referring to FIGS. 1–12, the present invention relates to a combination window seat and bed. The device comprises a rear section 1 including a planar, horizontal upper surface 2 with a pair of opposing sidewalls 3 and a rear wall 4 depending therefrom. A front portion 5 of the rear section is open.

Nested beneath the rear section is an intermediate section 6 that is slightly shorter than the rear section and which can be deployed via the open front. The intermediate section includes a planar, horizontal upper surface 7 with a plurality of support legs 8 depending therefrom. The legs are mounted on locking casters 55 allowing the intermediate section to easily roll on an underlying surface. The intermediate section further includes two or more tabs 9 upwardly extending from a rear edge to prevent the intermediate section from being separated from the rear section.

Nested beneath the intermediate section is a front section 10 that is slightly shorter than the intermediate section. The front section includes a planar, horizontal upper surface 11 having a plurality of support legs 12 with casters depending therefrom. Likewise, the front section includes a pair of tabs 13 upwardly extending from a rear edge that prevent the front section from being separated from the intermediate section. The front section further includes a front wall 14 having a pair of openings 15 thereon each of which slidably receive a drawer 16. The drawers each include ball bearing type slides 17 that glide on mating slides 18 positioned beneath the upper surface of the front section. The drawers can be used to store linen, bedclothes and similar items.

Figure 12:
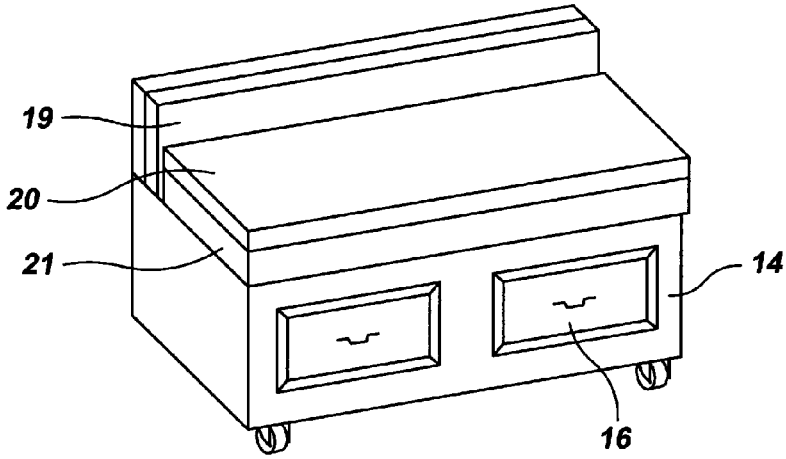
FIG. 12 is a perspective view of the device with the bed in a stored configuration to form a window seat.

The device also includes a cushion, formed of three panels, each of which is positioned on a respective horizontal upper surface of one of the sections. A first panel 19 is placed on the rear section and has a predetermined thickness. Preferably, the first panel includes a fold line allowing it to be folded into half of its normal width to form a backrest for the window seat as depicted in FIG. 12. A second panel 20 is placed on the intermediate section has a thickness greater than that of the rear panel while a third panel 21 is placed onto the front section and has a thickness greater than that of the intermediate and rear panels. The varying thicknesses are such that the upper surfaces of the panels, when placed on their respective sections, lie in the same horizontal plane to form a level, uniform sleeping surface when the device is expanded.

Accordingly, the device can be quickly and easily expanded to form a king-sized bed. When the device is not in use, the front and intermediate sections can be compactly nested beneath the rear section to form an unobtrusive window seat. As such, the sidewalls 3 and rear wall 4 of the rear section, the drawers 16 and the front section wall 14 are preferably constructed with furniture grade wood so that the device resembles an attractive piece of furniture when the device is converted to a window seat. Furthermore, the upper surfaces of the frame sections are formed of flattened metal arranged in a grid-like pattern with reinforcing strips 60 beneath. However, the construction of the cushion-supporting upper surfaces can be varied.

The above described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The invention claimed is:

1. A combination window seat and collapsible bed comprising:

a rear section including a planar, horizontal upper surface and an open front;

an intermediate section slidably received within the open front of the rear section, said intermediate section including a planar, horizontal upper surface with a plurality of support legs depending therefrom;

a front section slidably positioned beneath the intermediate section, said front section including a planar, horizontal upper surface with a plurality of support legs depending therefrom;

said front section and said intermediate section each including a tab extending upwardly from a rear edge thereof to prevent the intermediate section from separating from said rear section and from preventing said front section from separating from said intermediate section, said front section further including a front wall having a pair of openings thereon, each opening slidably receiving a drawer to accommodate personal items;

a cushion positionable on the upper surface of said rear section, said intermediate section and said front section to form a sleeping surface when said intermediate section is extended relative to said rear section and said front section is extended relative to said intermediate section thereby forming a bed;

said cushion including a first panel for positioning on the upper surface of said rear section, said first panel having a predetermined thickness;

a second panel for positioning on the upper surface of said intermediate section, said second panel having a thickness greater than that of the first section;

a third panel for positioning on the upper surface of the front section, said third panel having a thickness greater than that of both the first panel and the second panel such that the panels unitarily form a level, uniform sleeping surface when said cushion is positioned on said front section, intermediate section and said rear section.

2. The combination according to claim 1 wherein each drawer includes ball bearing type slides that glide along mating slides positioned within the front section to guide said drawers into and out of said openings.

* * * * *